United States Patent [19]

Baxter

[11] 4,040,365

[45] Aug. 9, 1977

[54] UTILITY SYSTEM WALL SAFE

[76] Inventor: Robert F. Baxter, 2944 Lincoln St., Highland, Ind. 46322

[21] Appl. No.: 600,647

[22] Filed: July 31, 1975

[51] Int. Cl.[2] ..... E05G 1/04

[52] U.S. Cl. ..... 109/50; 109/59 R

[58] Field of Search ..... 109/50, 51, 52, 59; 292/144, 145, 288

[56] References Cited

U.S. PATENT DOCUMENTS

| | | | |
|---|---|---|---|
| 968,536 | 8/1910 | Brucklacher | 109/50 |
| 1,613,813 | 1/1927 | Westland | 109/52 X |
| 2,629,349 | 2/1953 | Dean | 109/50 |
| 3,386,393 | 6/1968 | Peterson et al. | 109/50 |
| 3,417,715 | 12/1968 | Krieger et al. | 109/50 |

OTHER PUBLICATIONS

Popular Science, June 1959, p. 149.

*Primary Examiner*—Paul R. Gilliam
*Assistant Examiner*—David H. Corbin
*Attorney, Agent, or Firm*—John S. Wrona

[57] ABSTRACT

A wall safe simulating a piping or electrical system. The utility system wall safe is located on a lower level of a building. Access to the locking mechanism is preferably located at a different level or in a location remote therefrom if on the same level. To open or unlock the utility system that portion forming the cover to the wall safe may be removed.

1 Claim, 6 Drawing Figures

UTILITY SYSTEM WALL SAFE

BACKGROUND AND SUMMARY OF THE INVENTION

The present invention relates to wall safes and more particularly to a wall safe which simulates the piping or electrical system installed in buildings.

The wall safe of the present invention is particularly adapted to be installed in the basement of a residence wherein a plurality of pipes or electrical box and conduit form either the water supply, sewage disposal, or electrical systems.

The wall safe comprises generally a length of pipe permanently capped at one end to provide a compartment in which valuables may be stored. The safe section or capped length of pipe is supported in the wall or other structural member so as to be invisible.

The open end of the safe section is closed by a pipe or electrical section assembly which is readily accessible in the basement. The exposed pipe or electrical section closure assembly is constructed and arranged so as to resemble and simulate either a water, sewage disposal, or electrical box and conduit section. In this manner the safe closure is not readily discernible to a burglar or the like.

Further features of the invention will become readily apparent upon a reading of the following disclosure.

DESCRIPTION OF THE PREFERRED EMBODIMENTS

Figure 1:
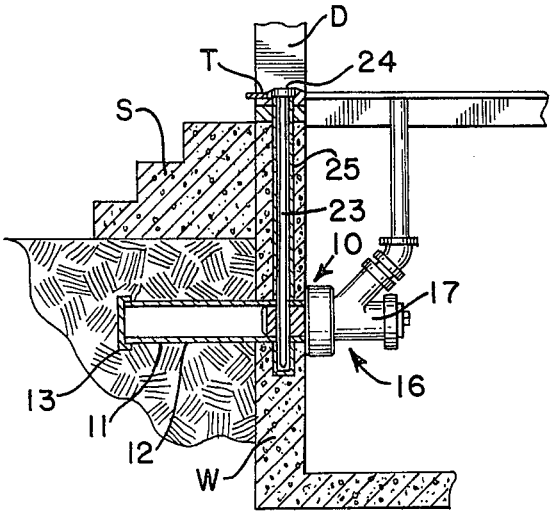
FIG. 1 is a fragmentary cross-sectional view of a wall safe installation embodying the piping system structure of the present invention.
Figure 2:
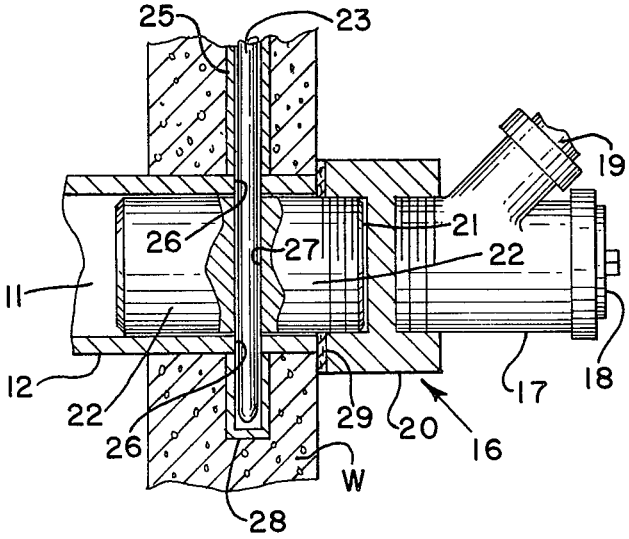
FIG. 2 is an enlarged cross-section view of the wall safe mounted in a wall and showing the closure end.
Figure 3:
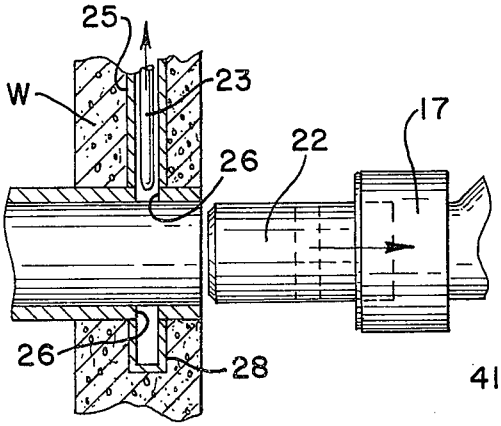
FIG. 3 is a view similar to FIG. 2 but showing the closure section removed.

Referring now to the drawings in particular in FIGS. 1 - 3 there is shown one embodiment of a utility system wall safe 10 incorporating the structure of the present invention. The wall safe 10 comprises a safe section or vault 11 formed from a length of pipe 12 which may be capped at one end by a cap 13. The pipe safe section 11 is embedded in a wall W and as shown preferrably below a stairway S in the vicinity of a doorway D or the like.

The open end of the wall safe section 11 is closed by a detachable closure assembly 16 which in the arrangement shown is a piping section assembly and is accessible in the basement. The closure assembly 16 simulates a length of the water or sewage system including a Y junction 17 which is closed by a cap 18. A pipe 19 is connected to the Y junction and extends toward the basement ceiling and may be connected to the existing water or sewer system in the basement.

A nipple 20 is threaded to the other end of the Y junction. The nipple 20 includes a closure wall 21 against which there abutts a closure plug 22 threaded into the opposite end. The closure plug 22 is slidably and snuggly received in the open end of the safe section or vault 11.

The closure is retained and locked in position by a locking pin 23 which generally extends vertically upward through the wall into a doorway, window or the like. In the embodiment shown the enlarged head 24 of the pin 23 is seated in a socket provided in the threshold T of the doorway D so as to be accessible. The other end of the pin which may be tapered extends through a guide pipe section 25 attached to the vault, through diametrically aligned openings 26 - 26 in the vault and through a diametrical passage 27 into a socket 28. In this manner the closure assembly 23 is locked in position. A gasket 29 is disposed over the plug 22 adjacent the nipple 20 to provide a seal when the vault 11 is locked.

To open the vault, the pin 23 is pulled upward at the doorway so that the lower end clears the plug 22. The pipe 19 is disconnected from the water or sewer system in the basement either before or after the pin 23 is pulled upward. Thereafter, the safe opener must descend into the basement so that the plug may be removed by grasping the simulated pipe closure assembly 16. The vault is closed in the reverse order from that described above.

Figure 4:
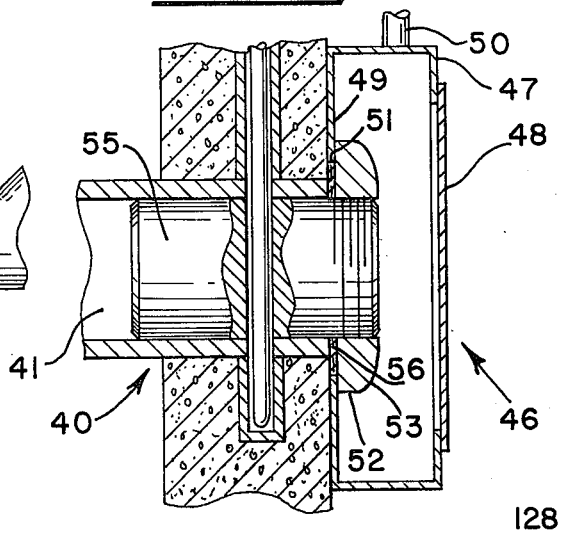
FIG. 4 is an enlarged cross-sectional view similar to FIG. 2 of another embodiment of the invention showing the electrical system structure of the present invention.

Referring now to FIG. 4 there is shown another embodiment of a utility system wall safe 40 incorporating the structure of the present invention. The open end of the wall safe section 41 is closed by a detachable closure assembly 46 which in the arrangement shown is an electrical section assembly. The closure assembly 46 simulates an electrical box 47 which is closed by a door 48. A conduit section 50 is connected to the electrical box and extends upward toward the ceiling and may be connected to the existing electrical system in the basement.

The electrical box is provided with an opening 51 for receiving a lock nut 52. The lock nut 52 includes a flange 53 which abutts the back wall 49 of the electrical box. The lock nut 52 is internally threaded to fasten on the threaded end of closure plug 55. A gasket 56 is disposed over plug 55 adjacent the locking nut 52 to provide a seal when the wall safe 40 is in a locked position.

Figure 5:
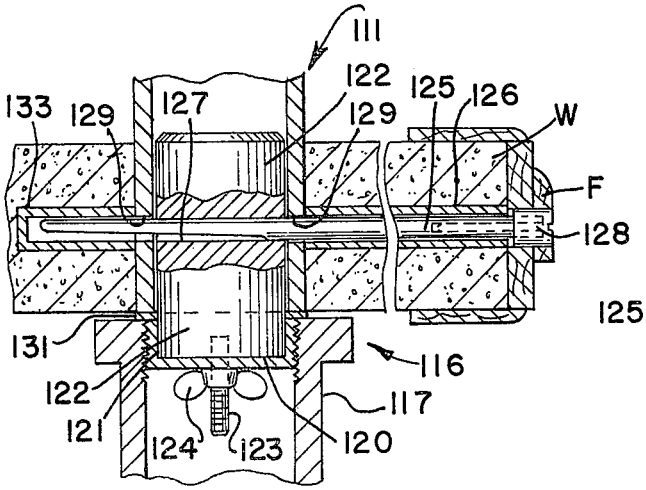
FIG. 5 is a fragmentary top cross-sectional plan view of another embodiment of the invention.
Figure 6:
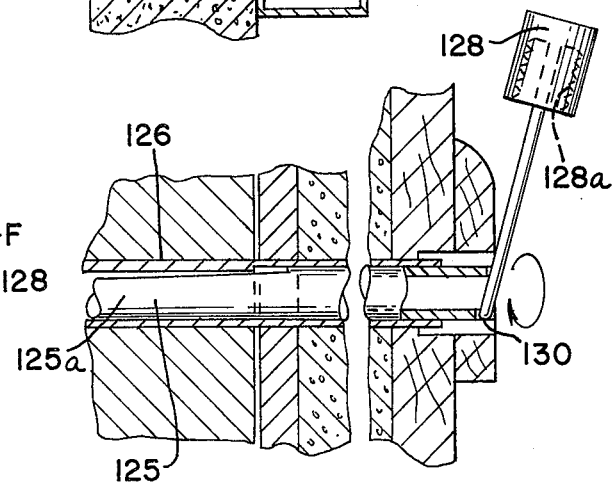
FIG. 6 is a fragmentary side cross-sectional view showing the manner in which the locking pin is activated in FIG. 5 to permit removal of the safe closure.

Referring now to FIGS. 5 and 6 there is shown another embodiment of a closure arrangement for closing the vault. The closure arrangement 116 includes a Y junction or T junction 117, the inner end of which there is internally threaded a cap 120. Seated within the flange 121 of the cap 120 is the closure plug 122 having a diametrically extending passage 127. A pin stud 123 is fixed to the outer end of the plug 122 and a threaded end extends through the cap 120 and receives a wing nut 124 for securing the plug 122 to the closure assembly 116.

A latching or locking pin 125 extends through the wall W, through a guide pipe section 126 into a window or door frame F or the like located remotely from the vault 111. An enlarged head pin 128 is accommodated within a socket in the frame. The head pin 128 includes an internally threaded end 128a for securing the head pin 128 to the guide pipe 126. The head pin 128 is removable received within an axial bore of the pin 125 for reasons which will be more fully explained hereinafter. An eccentrically tapered end 125a of the latching pin 125 is received in the openings 129 - 129, the diametrical passage 127 and the socket 133. Rotation of the pin 125 is accomplished by means of the head pin 128 which is removable and insertable in an end groove 130 in the pin 125 as shown in FIG. 6. Rotation of the locking pin releases the seal provided by a gasket 131 at the wall and facilitates the removal of the pin 125. Upon removal of the pin 125 the closure plug 122 may be removed so that access is available to the vault 111.

As is readily apparent from the foregoing, the excentrically tapered end 125*a* of the latching pin 125 may be centrically tapered and forced through the openings 129 – 129, the diametrical passage 127 and the socket 133 to lock the vault and compress the Y junction of T junction against the gasket 131 at the wall to provide the seal.

What is claimed is:

1. A wall safe comprising a vault pipe section in a wall, removable closure means simulating a utility system section extending from one face of the wall, said closure means including a plug removably inserted in the vault pipe section, gasket means provided at the face of said wall for providing a seal, an eccentrically tapered locking pin disposed in and passing through said vault pipe section and said plug thereby to compress said gasket and maintain a seal at the face when said locking pin is in a locked position, said locking pin being of a length so as to be accessible for removal and insertion from and into said plug at an opening in said wall remote from said vault pipe section, said locking pin including a removable head pin for rotating said locking pin to release said gasket means out of sealing relationship with said wall.

* * * * *